US009511616B1

(12) United States Patent
Young et al.

(10) Patent No.: US 9,511,616 B1
(45) Date of Patent: Dec. 6, 2016

(54) STAIR STEP PORTFOLIO FILE AND METHOD FOR MANUFACTURING SAME

(71) Applicant: Smead Manufacturing Company, Hastings, MN (US)

(72) Inventors: Glenda L. Young, Beldenville, WI (US); Daniel Seleski, Hastings, MN (US)

(73) Assignee: Smead Manufacturing Company, Hastings, MN (US)

( * ) Notice: Subject to any disclaimer, the term of this patent is extended or adjusted under 35 U.S.C. 154(b) by 0 days.

(21) Appl. No.: 14/709,975

(22) Filed: May 12, 2015

Related U.S. Application Data

(60) Provisional application No. 61/992,568, filed on May 13, 2014.

(51) Int. Cl.
*B65D 27/00* (2006.01)
*B42F 7/08* (2006.01)

(52) U.S. Cl.
CPC ..... *B42F 7/08* (2013.01)

(58) Field of Classification Search
CPC ..... B42F 17/18; B42F 17/32
USPC ..... 229/67.1–67.4, 72; 206/308.3, 309
See application file for complete search history.

(56) References Cited

U.S. PATENT DOCUMENTS 314,598 A 3/1885 Meek
923,539 A 6/1909 Law
1,572,239 A 2/1926 Low
1,600,999 A 9/1926 Sea
1,634,450 A 7/1927 Bushnell
2,323,245 A * 6/1943 Schenker ..... B42F 5/005 206/311
2,729,258 A 1/1956 Pentland et al.
3,113,573 A 12/1963 Schler
4,331,290 A 5/1982 Benham
4,444,314 A 4/1984 Jacobsson
4,540,390 A 9/1985 Thorschmidt
4,669,651 A 6/1987 Shaw et al.
4,730,727 A 3/1988 Petroff
4,762,225 A * 8/1988 Henkel ..... B65D 75/42 206/308.1
4,932,683 A 6/1990 Perazza
5,558,221 A * 9/1996 Scior ..... B65D 85/546 206/308.3
6,273,470 B1 8/2001 Bullock
6,419,082 B1 * 7/2002 Frankeny ..... G11B 33/0444 206/308.1
6,419,083 B1 * 7/2002 Huang ..... G11B 33/0444 206/308.1
6,443,301 B2 * 9/2002 Garnier ..... 206/308.1
(Continued)

OTHER PUBLICATIONS

Globe-Weis 13 Pocket Stand & File Portfolio & Quickvue File, Item No. 17125, dated Nov. 3, 2010.
(Continued)

*Primary Examiner* — Jes F Pascua
(74) *Attorney, Agent, or Firm* — Altera Law Group, LLC

(57) ABSTRACT

A stair-step, expandable file folder is disclosed, in which each pocket in the folder has the same depth, rather than the back pockets being deeper than the front pockets. The folder is formed from a unitary insert divider web. The divider is suspended above the floor of the folder by tabs which are affixed to the folder walls and by attachment to the inside from and back panels of the folder.

14 Claims, 7 Drawing Sheets

(56) References Cited

U.S. PATENT DOCUMENTS

| | | | | |
|---|---|---|---|---|
| 6,938,549 | B2 | 9/2005 | Bullock | |
| 8,425,387 | B1 | 4/2013 | Christensen et al. | |
| 2006/0113206 | A1 | 6/2006 | Warner | |
| 2007/0235506 | A1 | 10/2007 | Shapiro | |
| 2008/0197175 | A1 | 8/2008 | Christensen et al. | |
| 2011/0290866 | A1 | 12/2011 | Dodson | |
| 2012/0111930 | A1* | 5/2012 | Maistrellis | A45C 11/18 229/67.3 |

OTHER PUBLICATIONS

Esselte Pendaflex on The Go Desktop File, Item No. 51068, http://www.drillspot.com/products/476347/esselte_51068_on_the_go_desktop_file?s+1, dated Nov. 3, 2010.

Globe-Weis Quick Vue Project File, Monthly Index, Item No. 20135, http://www.amazon.com/Globe-Weia-QuickVue-Project-Monthly-20135/dp/B000Y9HO24, dated Nov. 3, 2010.

Globe-Weis Quick Vue Project File, A-Z Index, Item No. 20134, http://www.amazon.com/gp/product/B000FYZPRE/ref=pd_lpo_k2_sr_1?pf_rd_p=486, dated Nov. 3, 2010.

Globe-Weis Quick Vue Project File, Item No. 20131, dated Nov. 3, 2010.

* cited by examiner

STAIR STEP PORTFOLIO FILE AND METHOD FOR MANUFACTURING SAME

CROSS-REFERENCE TO RELATED APPLICATION

This application incorporates U.S. Pat. No. 8,425,387 issued 23 Apr. 2013 to Christensen et al by reference in their entirely.

BACKGROUND OF THE INVENTION

Field of the Invention

The present invention is directed to file folders, and more particularly to stair-step style expandable file folders.

Description of the Related Art

File folders are common in home and office settings.

A typical expandable file folder includes a series of rectangular dividers that are joined on three sides to respective pleats in an expandable gusset. The folder has pockets formed between each adjacent pair of dividers. Each pocket is accessible from the unbound edge of the dividers, which will be referred to in this document as the top edge of the file folder.

One common type of expandable file folder is referred to as a stair-step expandable folder. In a stair-step expandable folder, the dividers extend by different amounts along the top edge of the folder. The dividers at the back of the folder extend upward farther than those at the front of the folder, so that the top edges of all the dividers are viewable simultaneously. A user can select a desired pocket directly, rather than having to flip through all the dividers to find the correct pocket.

One potential drawback to typical stair-step expandable folders is that the pockets have different depths. Because the dividers at the rear of the folder extend farther upward than those at the front of the folder, the pockets at the rear of the folder are deeper than those at the front of the folder. As a result, documents stored in a rear pocket are more difficult to access than those stored in a front pocket. This difficulty in accessing the rear pockets is unacceptable.

Accordingly, there exists a need for a stair-step expandable file folder in which the stored documents are easily accessible for all pockets, and a suitable method for manufacturing such a folder.

In U.S. Pat. No. 8,425,387 a stair step file is disclosed. In this disclosure, we have invented structures and methods for simplification of the product and manufacture.

BRIEF SUMMARY OF THE INVENTION

The following summary is intended to help the reader understand the entire patent application and is not intended as a limitation on the scope of invention.

There is disclosed, amongst other things, a stair-step file folder having a plurality of top-accessible pockets, having a box frame having a bottom, left and right sidewalls and a front and back wall, said sidewalls having a plurality of vertically oriented accordion folds to allow expansion of the frame, a unitary divider web insert configured create a plurality of top accessible pockets of substantially equal depth having a. a continuous web of material folded to form a first panel attachable to said back wall, b. a second panel joined to said first panel at their bottom edges by a plurality of accordion folds having an apex and valleys other either side said apex thereby joining said first and second panels and providing expandability therebetween;

c. a third panel joined to said second panel at their bottom edges by a plurality of accordion folds having an apex and valleys other either side said apex thereby joining said second and third panels and providing expandability therebetween;

d. a fourth panel affixable to said front wall and also joined to said third panel at their bottom edges by a plurality of accordion folds having an apex and valleys other either side said apex thereby joining said third and fourth panels and providing expandability therebetween;

e. at least one of said panels including left and right flanges attachable to said accordion folds in said sidewalls, to maintain a fixed height of said pockets.

It is understood that this 4 pocket version is only exemplary. The box file could have more or less pockets build in a similar way.

Also disclosed is a folder wherein said flanges are attached to said sidewalls at a location which maintains said valleys generally coplanar and generally horizontal. By making the valleys coplanar the bottom of the pocket is uniform in depth.

Also disclosed is a folder wherein said flanges are lateral extensions from said panel and wherein said flanges an adhered to said accordion folds.

Also disclosed is a folder wherein each of said panels is sized to define a depth of pocket generally equal to other pockets.

Also disclosed is a folder wherein a final pocket is defined between said front wall and said fourth panel and wherein the bottom of said final pocket is the bottom of the frame.

Also disclosed is a folder wherein a first pocket is defined between said first and second panels and wherein said accordion fold constitute the floor thereof.

Also disclosed is a folder wherein a second pocket is defined between said second and third panels and wherein said accordion fold constitute the floor thereof.

Also disclosed is a folder wherein a third pocket is defined between said third and fourth panels and wherein said accordion fold constitute the floor thereof.

Also disclosed is a folder wherein said floors of successive pockets from first to third are successively vertically higher.

Also disclosed is a folder wherein said web insert includes a plurality of panels joined end to end to form a web.

Also disclosed is a stair-step file folder having a plurality of top-accessible pockets, has a box frame having a bottom, left and right sidewalls and a front and back wall; said sidewalls having a plurality of vertically oriented accordion folds to allow expansion of the frame; a unitary insert divider web configured create a plurality of top accessible pockets of substantially equal depth comprising:

a. a continuous web of material folded to form a first panel attachable to said back wall, b. a second panel joined to said first panel at their bottom edges by a fold therebetween;

c. a third panel joined to said second panel at their bottom edges by a fold therebetween;

d. a fourth panel affixable to said front wall and also joined to said third panel at their bottom edges by a fold therebetween;

e. at least one of said panels including left and right flanges attachable to said accordion folds in said sidewalls, to maintain a fixed height of said pockets.

Also disclosed is a method for constructing a stair-step file folder, having a box frame with zig zag gusset sloping sidewalls and front and back inner walls, the method including any or all of the following steps in any order:

cutting and folding a blank of material to create a unitary web insert dividers, having:

a first, second, third and fourth panel joined panels, each plane joined to the next by folding accordion folds therebetween to form bottoms of pockets, cutting said blank to create lateral flange extensions on said third and fourth panels;

affixing said flange extensions to said gusset sidewalls;

affixing said first and fourth panels to said front and back inner walls, said flange extensions and panels being affixed so that panels form a plurality of pockets of having bottoms being vertically progressively higher from front to back.

Also disclosed is a method of constructing a divider insert for a folder box as described above.

DETAILED DESCRIPTION OF THE INVENTION

A stair-step, expandable file folder is disclosed, in which each pocket in the folder has a pre-determinable depth, preferably the same depth, rather than the back pockets being automatically deeper than the front pockets. The folder preferably includes a unitary (single, unspliced piece) divider insert that forms the front and back sides of the pockets of the folder except for the first and last pocket wall. In the alternative, the divider insert can be made of a series of end to end connected elements. The divider when folded creates pockets of decreasing depth going from front to back in order that the height of the pocket bottom is increasing front to back to that articles (most often papers in backmost pockets will still be visible because top to bottom depth of the pockets remains generally equal.

It is however possible to utilize this invention to have pockets of different depth depending upon need. For example, it is possible that some pockets could be suitable for A-4 or letter size depth in landscape (horizontal) orientation while others could be in letter (vertical) orientation. Likewise, other paper formats could be accommodated by setting different predetermined depths for different pockets.

In our previous invention found in U.S. Pat. No. 8,425,387, we provided separate dividers for each pocket. In this invention, we have modified the structure to improve it in many ways including simplification in its manufacture and assembly.

The divider is folded to form a plurality of bottoms of the pockets, with the folded portions also increasing in height from the front to the back of the folder. The unitary (meaning either a single web or a series of webs joined together end to end to form a single web) divider extends downward to form the back face of a pocket, is folded forward to form the bottom face of the pocket, and is folded upwardly again to form a wall of the next pocket, and so on. To maintain the divider in its position suspended above the bottom of its box/frame container (forming surrounding walls, at least one of the divider sections includes bendable flanges which can be mounted, such as by adhesive on the inside wall of the box at a predetermined height above the box floor. This creates the stair step "stadium" style ascending pocket height so that items in the pockets are equally visible in upper as well as lower pockets.

The preceding paragraphs are merely a summary, and should not be construed as limiting in any way. A more detailed description follows, first of the folder itself in figures and the accompanying text, then of the method of manufacturing such a folder.

Figure 1:
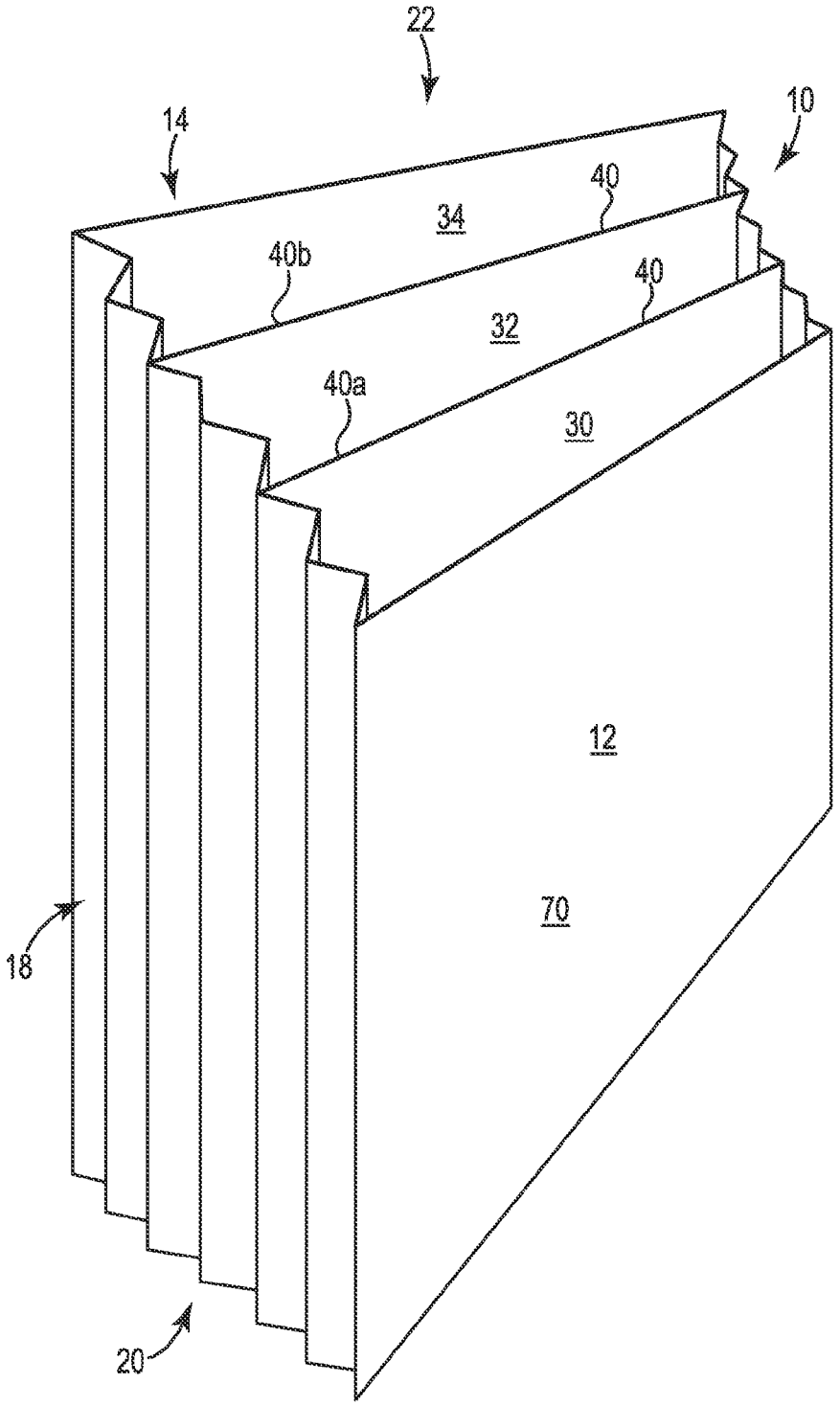
FIG. 1 is perspective view of an expandable stair-step folder.

FIG. 1 is a perspective view of a stair step or stadium portfolio file 10. It has a front face 12, a rear or back face 14, left and right symmetric sidewalls 18 which are preferably according material or stretchable to accommodate filling of the defined space, a bottom 20 and an open top 22. This defines an accordion box frame with sidewalls that slope downwardly toward the front and with space inside.

In this embodiment there are three pockets 30, 32, and 34 defined by a unitary web divider (unitary has been defined above), 40 with panels 40*a*, 40*b* visible in this view.

Figure 2:
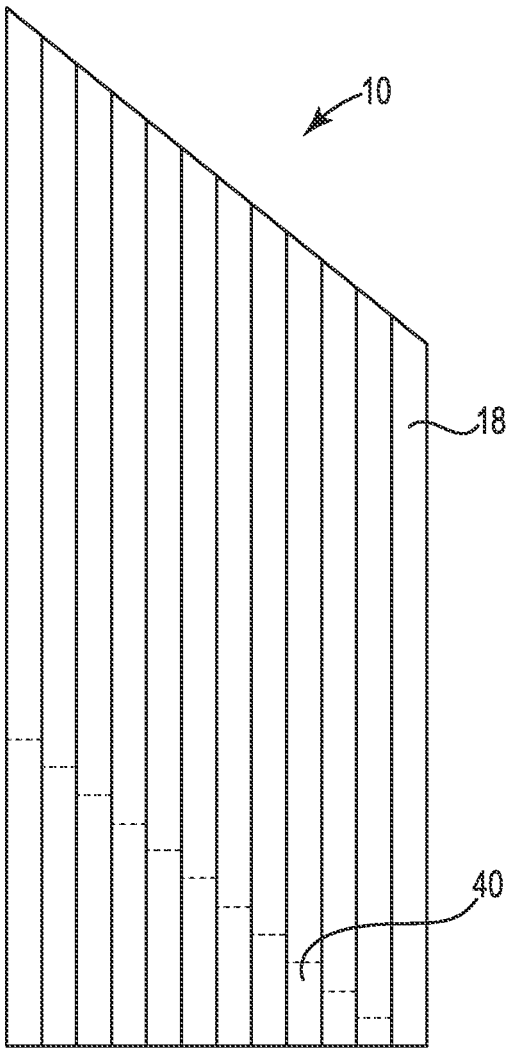
FIG. 2 is a side view of the subject matter of FIG. 1 with broken lines to illustrate steps within the interior.

FIG. 2 illustrates as side view the bottom of the divider 40 shown in phantom. Notices that it is a stair step. In phantom lines, many more steps are shown that are actually illustrated in FIG. 1, so as to make clear that there can be many more pockets.

Figure 6:
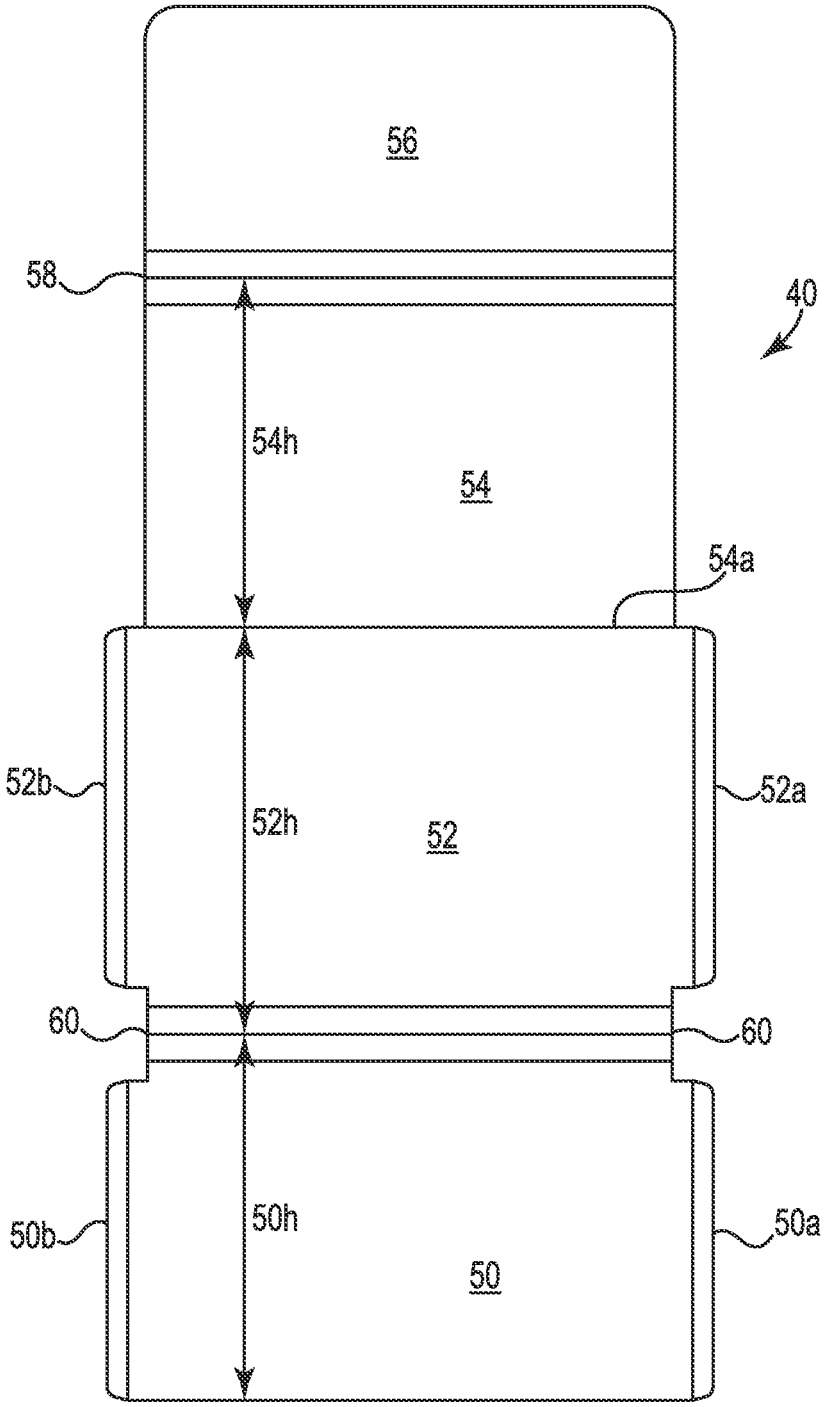
FIG. 6 is a view of the insert separator of FIG. 3 folded flat.

FIG. 6 shows the accordion fold side and bottom walls which have a plurality of folds which form an expanding gusset typically of paper or Tyvek®.

Figure 7:
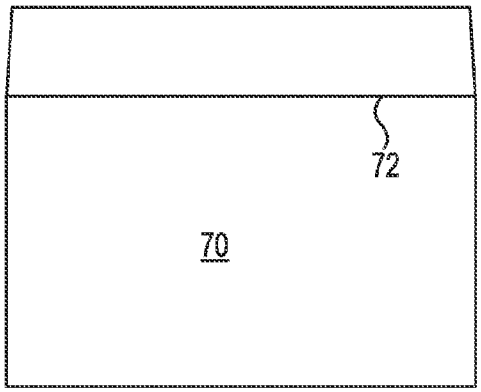
FIG. 7 is a front plan view of the overwrap front panel.
Figure 8:
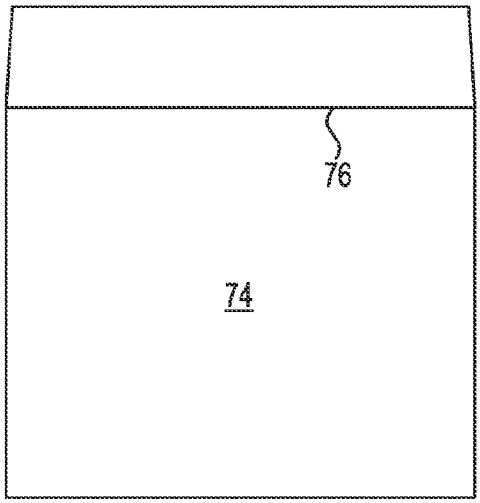
FIG. 8 is a rear plan view of the overwrap back panel.
Figure 9:
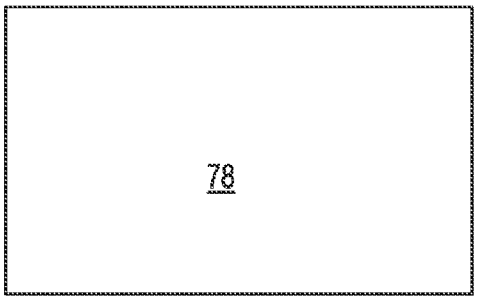
FIG. 9 is a front plan view of the front panel.
Figure 10:
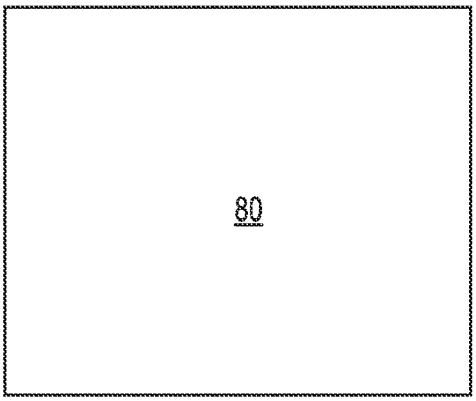
FIG. 10 is a front plan view of the back panel.

FIGS. 7, 8, 9, 10 represent optional cover sheets which can be applied over various walls of the box. FIG. 7 illustrates a front cover 70 with a fold 71. The lower portion is applied to the box as shown in FIG. 1 and the smaller portion is folded into the inside. FIG. 8 is a back cover panel 74 with a like fold 74. It is applied to the back side with the fold over flap folded into the box and affixed. FIGS. 9 and 10 are interior cover sheets 78, 80 which applied to the interior of the box over flaps to provide a seamless appearance.

Figure 3:
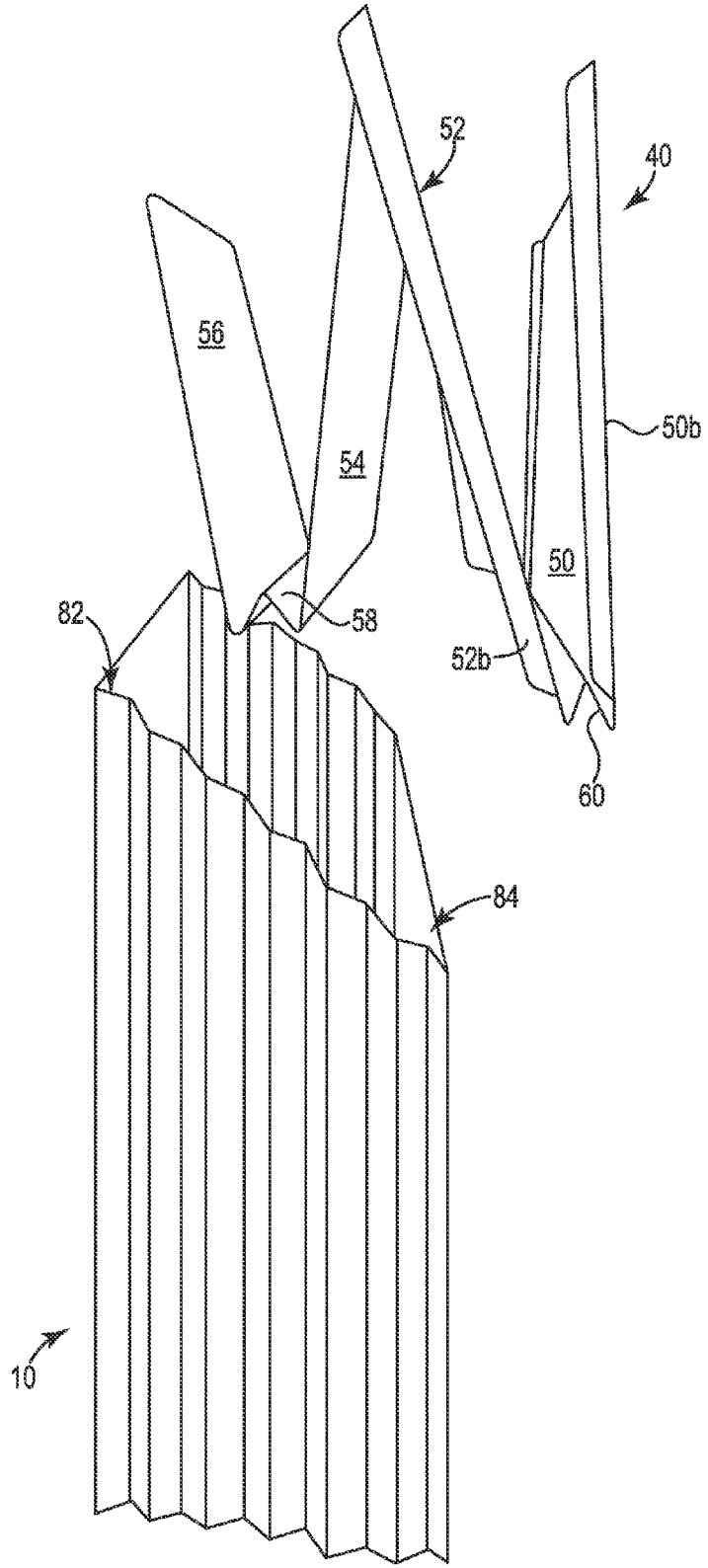
FIG. 3 is a side perspective view of FIG. 1 with the interior separator removed.
Figure 4:
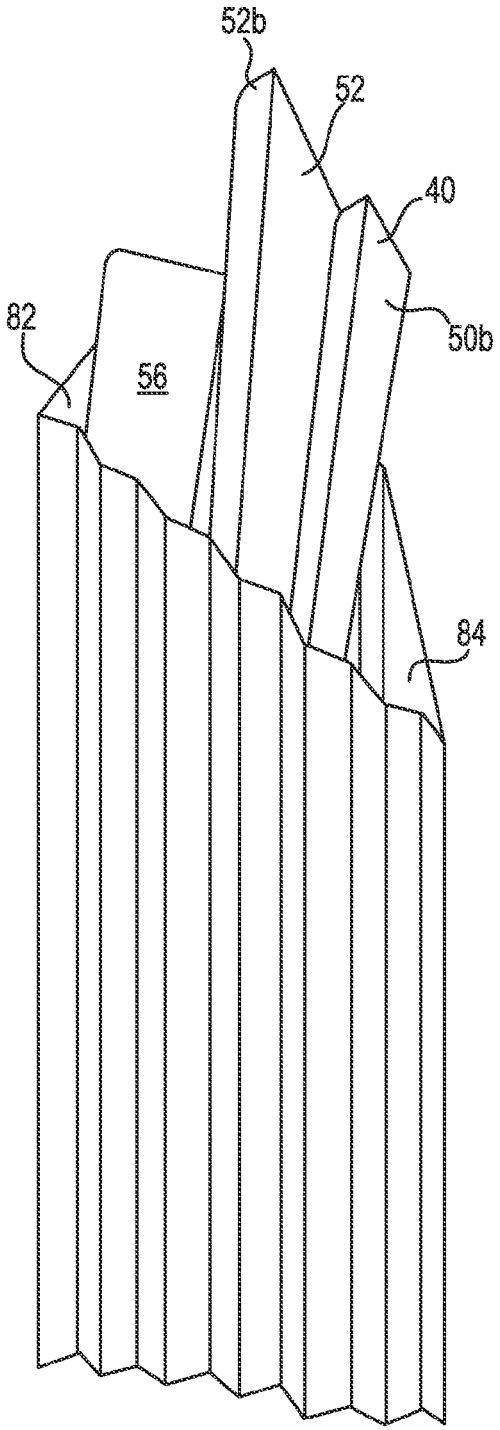
FIG. 4 is a view like FIG. 3 with the separator partly removed.
Figure 5:
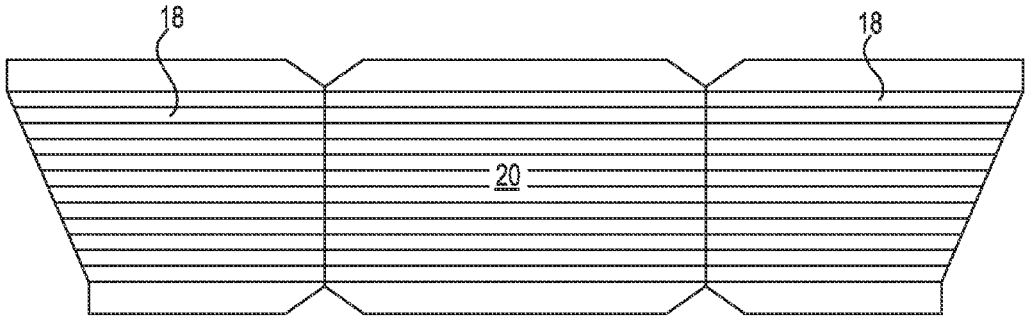
FIG. 5 is a plan view of the gusset panel of FIG. 1 folded flat.

The unitary divider 40 is shown in various folded positions in FIGS. 3, 4 and 6. In FIG. 6 the various folds sub-elements are:

Panel 50, having foldable tabs or flaps 50*a*-50*b;*

Panel 52 with foldable tabs 52*a*-52*b* and joined to panel 50 by a plurality of zig zag fold lines 60;

Panel 54 joined to panel 52 by at a fold line 54*a;*

Panel 56, joined to panel 54 by a plurality of zig zag folds 58.

While it is difficult to show in 2D, FIGS. 3 and 4 illustrate how the insert is placed in the box and affixed to create pockets.

Panel 56 is affixed to the inner back wall 82 of box 10. Panel 56, portion 58 and Panel 54 make up the back most pocket. They are suspended by the fact that the divider is a single web so that panel 52 actually supports that rearward pocket. Panel 52 is suspended in by affixing flaps 52*a-b* to their respective inner sidewalls 18 of the box. Then foldable tabs 50*a-b* are similarly affixed to another more forwardly portion of sidewalls 18 thereby creating a second and third pocket, the middle pocket formed between panels 52 and 50 and the front pocket formed between panels 50 and the space between it and the front most wall 84 of the box.

In order that the pockets remain at the same or other predetermined depth from front to back, the position of folds 54*a*, 58 and 60 and the respective heights 52*h*, 54*h* (as measured from the center fold line of 58 and 60, to the top of the panel must be selected so that the depth the pockets is substantially the same regardless of position.

For the back pocket, this is determined by height from the fold 54*h* (assuming that panel 54 is placed so that folds 58 are coplanar). Likewise panel 50 should be affixed to inner wall 84 keeping folds 60 coplanar (i.e. the troughs are in the same plane).

If it is desired that the pockets have the same depth regardless of which pocket in the stair step, this is accomplished by adjusting the height of the bottom (58, 60) of each pocket so that it is set at a higher level for each step up. Thus, if front of the next succeeding pocket is 2 cm higher than the next lower one, then the bottom of each pocket must be likewise 2 cm higher and its supporting panels adjusted accordingly. This provides for uniform pocket depth.

Tabs 52*a-b* and 50*a-b* are formed by cutting a blank as shown in FIG. 6. It is understood that the tabs can be added to the web separately and not part of the blank. Other means for affixing the tabs or even the panels, beside adhesive are possible. For example, the tabs and indeed all point of affixation of the web could be a releasable adhesive so that different web inserts could be used for different number of pockets while reusing the same box.

So there is disclosed, amongst other things, a stair-step file folder having a plurality of top-accessible pockets, having a box frame having a bottom, left and right sidewalls and a front and back wall, said sidewalls having a plurality of vertically oriented accordion folds to allow expansion of the frame, a unitary divider web insert configured create a plurality of top accessible pockets of substantially equal depth having:

a. a continuous web of material folded to form a first panel attachable to said back wall, (continuous may also be segmented but joined together);

b. a second panel joined to said first panel at their bottom edges by a plurality of accordion folds having an apex and valleys other either side said apex thereby joining said first and second panels and providing expandability therebetween; (the accordion folds 58, 60 may also simply be just flat bottom segments of the web with spaced part folds);

c. a third panel joined to said second panel at their bottom edges by a plurality of accordion folds having an apex and valleys other either side said apex thereby joining said second and third panels and providing expandability therebetween;

d. a fourth panel affixable to said front wall and also joined to said third panel at their bottom edges by a plurality of accordion folds having an apex and valleys other either side said apex thereby joining said third and fourth panels and providing expandability therebetween;

e. at least one of said panels including left and right flanges attachable to said accordion folds in said sidewalls, to maintain a fixed height of said pockets.

It is understood that this 4 pocket version is only exemplary. The box file could have more or less pockets build in a similar way.

Also disclosed is a method for constructing a stair-step file folder, having a box frame with zig zag gusset sloping sidewalls and front and back inner walls, the method including any or all of the following steps in any order:

cutting and folding a blank of material to create a unitary web insert dividers, having:

a first, second, third and fourth panel joined panels, each plane joined to the next by folding accordion folds therebetween to form bottoms of pockets, cutting said blank to create lateral flange extensions on said third and fourth panels;

affixing said flange extensions to said gusset sidewalls;

affixing said first and fourth panels to said front and back inner walls;

said flange extensions and panels being affixed so that panels form a plurality of pockets of having bottoms being vertically progressively higher from front to back.

Also disclosed is a method of constructing a divider insert for a folder cutting and folding a blank of material to create a unitary web insert dividers, having:

a first, second, third and fourth panel joined panels, each plane joined to the next by folding accordion folds therebetween to form bottoms of pockets, cutting said blank to create lateral flange extensions on said third and fourth panels;

inserting the blank into the box;

affixing said flange extensions to said gusset sidewalls;

affixing said first and fourth panels to said front and back inner walls;

said flange extensions and panels being affixed so that panels form a plurality of pockets of having bottoms being vertically progressively higher from front to back.

The divider is supported on its side by an expandable gusset that surrounds them on the bottom and left and right sides of the folder. The gussets can be a web material which provides lightness and airflow, or solid.

In contrast with many known expandable folders, in which the pocket depth increases from the front to the back of the folder, the folder can have a uniform pocket depth from the front to back of the folder.

The description of the invention and its applications as set forth herein is illustrative and is not intended to limit the scope of the invention. Variations and modifications of the embodiments disclosed herein are possible and practical alternatives to and equivalents of the various elements of the embodiments would be understood to those of ordinary skill in the art upon study of this patent document. These and other variations and modifications of the embodiments disclosed herein may be made without departing from the scope and spirit of the invention.

We claim:

1. A stair-step file folder having a plurality of top-accessible pockets, comprising:

a box frame having a bottom, left and right sidewalls and a front and back wall said sidewalls having a plurality of vertically oriented accordion folds to allow expansion of the frame;

a unitary divider web insert configured create a plurality of top accessible immediately adjacent pockets each being of substantially equal depth and configured in a stair step arrangement comprising:

a. a continuous web of material folded to form a first panel attachable to said back wall;

b. a second panel joined to said first panel at their bottom edges by at least one accordion fold forming an apex and valleys on either side said apex thereby joining said first and second panels and providing expandability therebetween;

c. a third panel joined to said second panel at their top edge folded thereby forming an apex and valleys on either side said apex thereby joining said second and third panels and providing expandability therebetween;

d. a fourth panel affixable to said front wall and also joined to said third panel at their bottom edges at least one accordion fold forming an apex and valleys on either side said apex thereby joining said third and fourth panels and providing expandability therebetween;

e. at least one of said panels including left and right flanges attachable to said accordion folds in said sidewalls, to maintain a fixed height of said pockets wherein said continuous web is folded into a plurality of individual pockets including said flanges, formed from a single connected web.

2. The folder of claim 1 wherein said flanges are attached to said sidewalls at a location which maintains said valleys generally coplanar and generally horizontal.

3. The folder of claim 1 wherein said flanges are lateral extensions from said panel and wherein said flanges an adhered to said accordion folds.

4. The folder of claim 1 wherein each of said panels is sized to define a depth of pocket generally equal to other pockets.

5. The folder of claim 1 wherein a final pocket is defined between said front wall and said fourth panel and wherein the bottom of said final pocket is the bottom of the frame.

6. The folder of claim 5 wherein a first pocket is defined between said first and second panels and wherein said accordion fold constitute the floor thereof.

7. The folder of claim 6 wherein a second pocket is defined between said second and third panels and wherein said accordion fold constitute the floor thereof.

8. The folder of claim 7 wherein a third pocket is defined between said third and fourth panels and wherein said accordion fold constitute the floor thereof.

9. The folder of claim 8 wherein said floors of successive pockets from first to third are successively vertically higher.

10. The folder of claim 1 wherein said web insert includes a plurality of panels joined end to end to form a web.

11. A stair-step file folder having a plurality of top-accessible pockets, comprising:

a box frame having a bottom, left and right sidewalls and a front and back wall said sidewalls having a plurality of vertically oriented accordion folds to allow expansion of the frame;

a unitary insert divider web configured create a plurality of top accessible pockets of substantially equal depth and configured in a stair step arrangement comprising:

a. a continuous web of material folded to form a first panel attachable to said back wall, b. a second panel joined to said first panel at their bottom edges by a fold therebetween;

c. a third panel joined to said second panel at their top edge by a fold therebetween;

d. a fourth panel affixable to said front wall and also joined to said third panel at their bottom edges by a fold therebetween;

e. at least one of said panels including left and right flanges attachable to said accordion folds in said sidewalls, to maintain a fixed height of said pockets wherein said continuous web is folded into a plurality of individual pockets including said flanges, formed from a single connected web.

12. A method for constructing a stair-step file folder, having a box frame with zig zag gusset sloping sidewalls and front and back inner walls, the method comprising:

cutting and folding a blank of material to create a unitary continuous web insert dividers, the continuous web being folded into a plurality of individual pockets including flanges, formed from a single connected web, having:

a first, second, third and fourth panel joined panels, each plane joined to the next by folding accordion folds therebetween to form bottoms of pockets, cutting said blank to create lateral flange extensions on said third and fourth panels;

creating at least one accordion fold from the continuous web between the first and second panels and the third and fourth panels, to create expandable bottom between said panels;

affixing said flange extensions to said gusset sidewalls;

affixing said first and fourth panels to said front and back inner walls, said flange extensions and panels being affixed so that panels form a plurality of pockets of having bottoms being vertically progressively higher from front to back in a stair step arrangement.

13. The method of claim 12 further including folding an accordion gusset to form sides and bottom walls of said folder and wherein affixing the first and fourth panels includes affixing said panels at a height from the bottom such that the bottoms are progressively higher from the bottom from front to back.

14. The method of claim 12 further including cutting the blank of material while retaining it as a single unspliced unitary sheet.

* * * * *